US005464181A

United States Patent [19]

Leventhal

[11] Patent Number: 5,464,181

[45] Date of Patent: Nov. 7, 1995

[54] BROOM HOLDER

[76] Inventor: Harry Leventhal, 17031 Boca Club Blvd., Boca Raton, Fla. 33487

[21] Appl. No.: 320,325

[22] Filed: Oct. 11, 1994

[51] Int. Cl.[6] ..... A46B 17/02

[52] U.S. Cl. ..... 248/113; 211/89; 248/316.7

[58] Field of Search ..... 248/113, 110, 248/316.7; 211/62, 63, 65, 66, 89

[56] References Cited

U.S. PATENT DOCUMENTS

| | | | |
|---|---|---|---|
| 307,761 | 11/1884 | Harger | 248/113 |
| D. 326,220 | 5/1992 | Hampshire | 248/316.3 |
| 901,179 | 10/1908 | Kunkel | 248/113 |
| 1,344,728 | 6/1920 | Shively | 248/113 |
| 2,707,052 | 4/1955 | Brown | 211/65 |
| 3,007,618 | 11/1961 | Davis | 211/65 X |
| 4,121,798 | 10/1978 | Schumacher | 248/113 |
| 4,129,916 | 4/1964 | Patterson | 248/113 |
| 5,056,748 | 10/1991 | Meyer | 248/316.7 |
| 5,165,629 | 11/1992 | Breveglieri | 248/110 |

*Primary Examiner*—J. Franklin Foss
*Attorney, Agent, or Firm*—R. William Graham

[57] ABSTRACT

The present invention is directed to a broom holder which includes a base plate, a retaining member extending from a first side of said base plate in a laterally spaced relation thereto configured to be removably mounted to a shopping cart, and a handle holding member extending from a second side of said base plate.

9 Claims, 1 Drawing Sheet

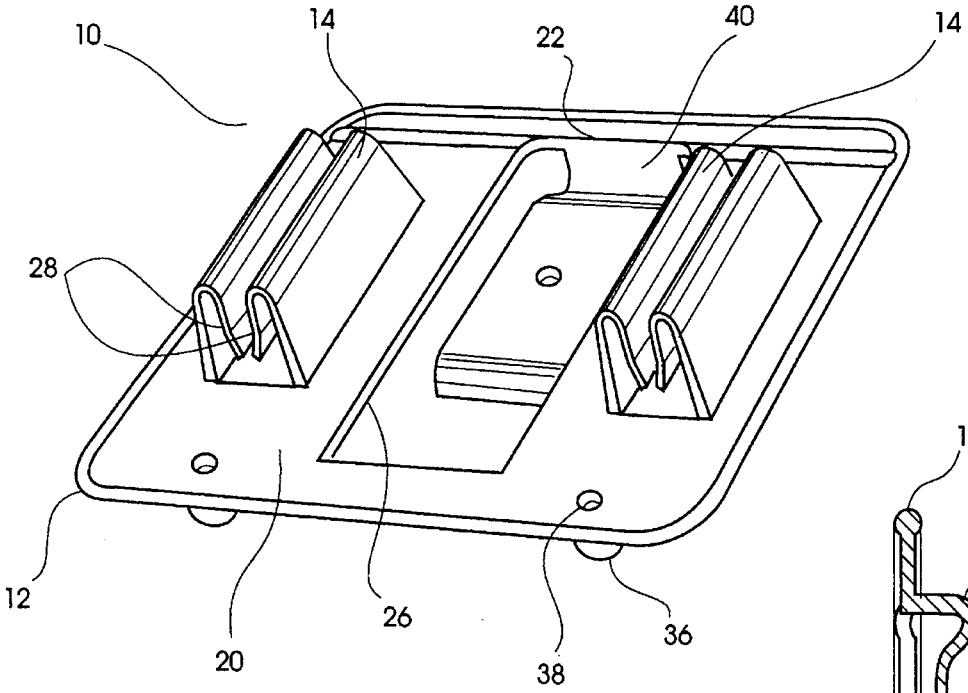
Fig. 1
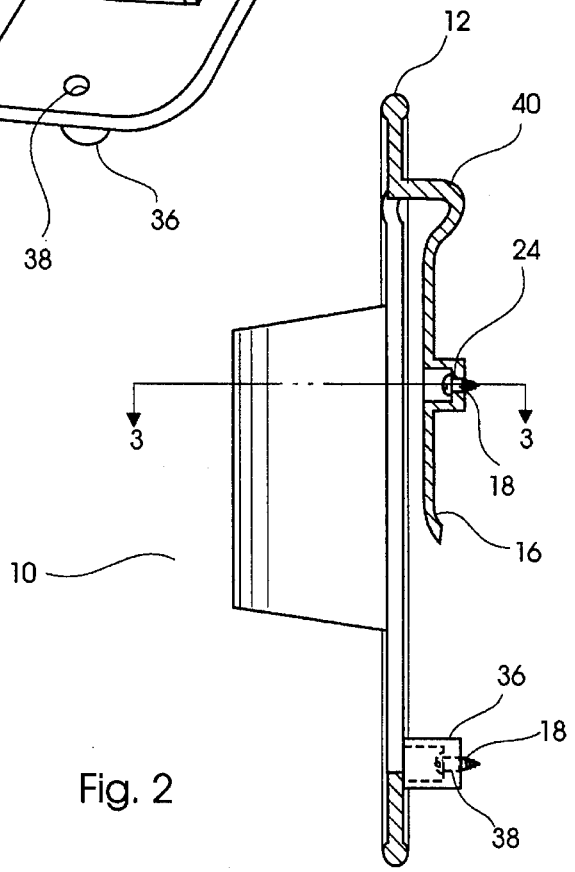
Fig. 2
Fig. 3
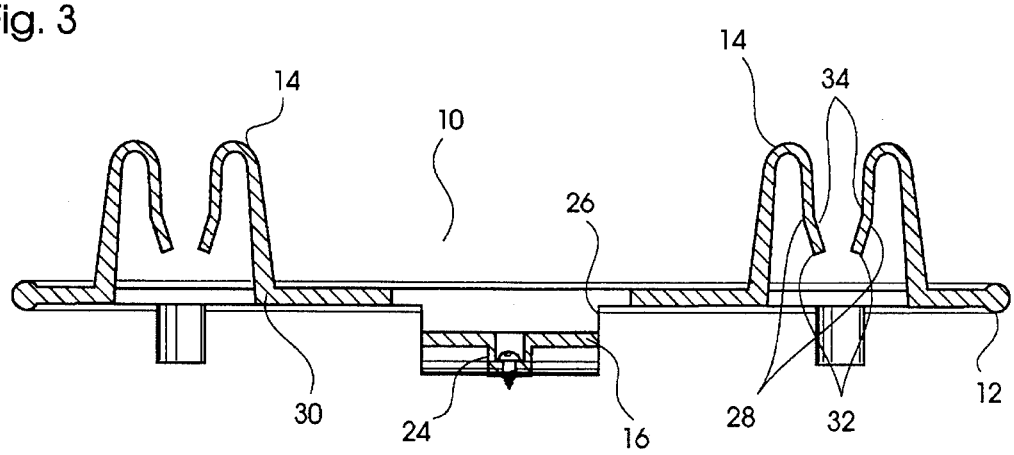

BROOM HOLDER

BACKGROUND OF THE INVENTION

1. Field of the Invention

This invention relates to a holding device for handled objects and more particularly, but not by way of limitation, to a broom holder.

2. Related Art

A number of handle holding devices exist for holding handles of brooms, mops, tools or the like. Such devices operate through gravity and/or friction which engage about the handle. The devices are typically securable to a wall.

Prior hereto, however, there has been a lack of appreciation to aid the shopper in his/her trip at the local store whereat he/she not infrequently is need of purchasing a broom or other elongated handled object. At such time, the shopper lacks an appropriate place to position the broom or mop and it often sticks awkwardly out of a shopping cart. This can cause a disturbance in traveling through the shopping aisles and potentially cause an injury to another shopper. There is, therefore, a need to overcome this problem which exists.

SUMMARY OF THE PRESENT INVENTION

It is an object, therefore, to reduce shopping disturbances caused by elongated objects awkwardly protruding from a shopping cart by providing a suitable holding device therefor.

It is another object to provide a broom holder which is useful while shopping as well at home or business.

Accordingly, the present invention is directed to a broom holder comprising a base plate, a retaining member extending from a first side of the base plate in a laterally spaced relation thereto configured to be removably mounted to a shopping cart and a handle holding member extending from a second side of the base plate. Also, one of the retaining member and/or base plate includes a threaded aperture surface and a screw threadably connectable to the aperture surface and of a length to extend therethrough to permit attachment of the broom holder to a wall or the like. The handle holding member includes a pair of elongated inverted J-shaped members, wherein one end of each of the J-shaped member is connected to the base plate and another end of each of the J-shaped member is free and flaring toward one another to create a handle receiving surface therebetween.

The foregoing and other objects will be readily apparent to those skilled in the art upon reading the following description, drawings and claims appended hereto.

BRIEF DESCRIPTION OF THE DRAWINGS

FIG. 1 is a perspective view of the present invention;

FIG. 2 is a side view of the present invention; and

FIG. 3 is a cross section of the present invention taken along line 3—3 of FIG. 2.

DETAILED DESCRIPTION OF THE PREFERRED EMBODIMENT

Referring to the drawings, the broom holder is generally designated by the numeral 10. The broom holder 10 generally includes a base plate 12, broom holding members 14, retaining/mounting member 16 and securing screws 18.

More particularly, the base plate 12 is formed with a generally planar member 20 having a portion 22 thereof connected to the retaining member 16, which is laterally spaced from and in parallel relation to the planar member 20. The retaining member 16 has centrally located therein a threaded aperture 24 to receive one of said screws 18 therein. Adjacent the portion 22 and extending about the retaining member 16 is an open surface portion 26 defining an opening to permit shopping cart bars to pass therethrough.

Adjacent and laterally spaced from the open surface portion 26 and extending outwardly from one side of the planar member 20 are the broom holding members 14. Each member 14 includes a pair of inverted elongated J-shaped members 28. One end 30 of each J-shaped member 28 is connected to the planar member 20 and the other end 32 is free and flares outwardly such that when the a pair of the J-shaped members 28 face each other, as shown in the FIGS. 1 and 2, there is created between the inverted J-shaped members 28 is a pair of receiving surfaces 34 for a handle of a broom.

The broom holder 10 is molded from a resilient material such as plastic or suitable metal. The J-shaped members 28 are formed with a degree of flexibility to permit expansion of the area between the receiving surfaces 34 to enable holding of moderately different handle sizes. When a handle is placed between the receiving surfaces 34 and seated firmly therebetween, a pressure fit is formed which holds the handle and broom head or the like attached thereto firmly in position.

Extending outwardly from another side of the planar member 20 are support members 36 having threaded apertures 38. Together with the retaining member 16, the broom holder 10 can be securely fastened to a shopping cart. Specifically, a bar of the shopping cart is positioned between the retaining member 16 and planar member 20 and seated in a well-portion 40 of the retaining member 16. The support members 36 seat between a pair of respective bars to prevent the holder 10 from undue pivoting.

The retaining member 16 in conjunction with the support members 36 holds the broom holder 10 in place during shopping and permits handles of brooms or the like to be safely held in place during shopping. Additionally, upon check out, the broom holder 10 may be quickly removed from the cart in a reverse manner and taken home, for example, for use in a fixed manner. In this regard, the retainer member 16 and support members 36 provide in this case a three (3) point contact surface plane which readily permits permanent fixing of the broom holder 10 to a wall or the like. Screws 18 are threaded through apertures 24 and 38 to mount the broom holder 10 to the wall.

While the preferred embodiment has been shown and described above, other modifications, variations and derivations will be readily apparent to those skilled in the art. As such, the modifications, variations and derivations should be included in the scope to be afforded the claims appended hereto.

What is claimed is:

1. A broom holder for use with a conventional shopping cart, wherein the shopping cart is constructed of interconnecting bars, comprising:

a base plate;

a retaining member extending from a first side of said base plate in a laterally spaced relation thereto configured to enable removable mounting of said broom holder to a shopping cart, said retainer having a well portion to seatably receive a first bar of the cart;

a support member laterally spaced from said retainer which extends from said first side of said base plate such that when said first bar is positioned within said well portion said support is positioned between a pair of adjacent bars to prevent said holder from undue pivoting; and a handle holding member extending from a second side of said base plate.

2. The broom handle of claim 1, wherein said retaining member includes a threaded aperture surface and a screw threadably connectable to said aperture surface and of a length to extend therethrough to permit attachment of said broom holder to a wall.

3. The broom handle of claim 1, wherein said base plate includes a threaded aperture surface and a screw threadably connectable to said aperture surface and of a length to extend therethrough to permit attachment of said broom holder to a wall.

4. The broom holder of claim 1, wherein said support member and retaining member are further characterized to terminate in a common plane to enable stable placement of said broom holder on a relatively flat surface.

5. The broom holder of claim 1, wherein said support member and said retaining member each have a threaded aperture surface therethrough and said broom holder further includes a plurality of screws threadably connectable to one of said aperture surfaces and of a length to extend therethrough to permit attachment to a wall.

6. The broom holder of claim 1, wherein said handle holding member includes a pair of elongated inverted J-shaped members, wherein one end of each said J-shaped member is connected to said base plate and another end of each said J-shaped member is free and flaring toward one another to create a handle receiving surface therebetween.

7. A broom holder for use with a conventional shopping cart, wherein the shopping cart is constructed of interconnecting bars, comprising:

a base plate;

a retaining member extending from a first side of said base plate in a laterally spaced relation thereto configured to enable removable mounting of said broom holder to a shopping cart, said retainer having a well portion to seatably receive a first bar of the cart;

a support member laterally spaced from said retainer which extends from said first side of said base plate such that when said first bar is positioned within said well portion said support is positioned between a pair of adjacent bars to prevent said holder from undue pivoting; and a handle holding member extending from a second side of said base plate.

8. The broom holder of claim 7, wherein said support member and retaining member are further characterized to terminate in a common plane to enable stable placement of said broom holder on a relatively flat surface and wherein said support member and said retaining member each have a threaded aperture surface therethrough and said broom holder further includes a plurality of screws threadably connectable to one of said aperture surfaces and of a length to extend therethrough to permit attachment to a wall.

9. The broom holder of claim 7, wherein said handle holding member includes a pair of elongated inverted J-shaped members, wherein one end of each said J-shaped member is connected to said base plate and another end of each said J-shaped member is free and flaring toward one another to create a handle receiving surface therebetween.

* * * * *